US008727901B1

(12) United States Patent
Dipatri

(10) Patent No.: US 8,727,901 B1
(45) Date of Patent: May 20, 2014

(54) DEVICE AND METHOD TO CORRECT A GOLF SLICE

(76) Inventor: Kyle Dipatri, Middleburg, FL (US)

( * ) Notice: Subject to any disclaimer, the term of this patent is extended or adjusted under 35 U.S.C. 154(b) by 70 days.

(21) Appl. No.: 13/611,207

(22) Filed: Sep. 12, 2012

(51) Int. Cl.
*A63B 69/36* (2006.01)

(52) U.S. Cl.
USPC ..... 473/262; 473/257; 473/265; 473/409

(58) Field of Classification Search
USPC ..... 473/257, 262–265, 278, 279, 409
See application file for complete search history.

(56) References Cited

U.S. PATENT DOCUMENTS

| | | | | | |
|---|---|---|---|---|---|
| 3,427,031 | A * | 2/1969 | Scott | ..... | 473/262 |
| 3,753,563 | A * | 8/1973 | Previte, Jr. | ..... | 473/265 |
| 4,786,057 | A * | 11/1988 | Brown | ..... | 473/265 |
| 5,224,709 | A * | 7/1993 | Buck, Jr. | ..... | 473/263 |
| 5,441,265 | A * | 8/1995 | Codlin | ..... | 473/160 |

* cited by examiner

*Primary Examiner* — Nini Legesse
(74) *Attorney, Agent, or Firm* — Lawrence J. Gibney, Jr.

(57) ABSTRACT

One of the most challenging aspects of golfing is the consistent ability to perfect the swing. After the ball is struck, it may either veer away from the golfer and this in known as a slice or veer towards the golfer and this is known as a hook. The slice is the more troublesome shot because it occurs most frequently and is the most difficult to correct. The current device will establish for the golfer the correct path for the club as it strikes the ball so that the slice is corrected and the ball travels in a straight direction.

6 Claims, 5 Drawing Sheets

(ISOMETRIC VIEW)

(TOP VIEW)

(FRONT VIEW)

(SIDE VIEW)

DEVICE AND METHOD TO CORRECT A GOLF SLICE

BACKGROUND OF THE INVENTION

A. Field of the Invention

This relates to the field and game of golf, specifically a teaching aide to correct a golfer's swing. This device is specifically designed to correct the slice, which would involve the right-handed golfer going to the right as opposed to the left-handed golfer going to the left.

B. Prior Art

There are numerous prior art references to golfing devices, specifically golfing training devices.

A representative example of this in regard to correcting a slice can be found at Buck, U.S. Pat. No. 5,224,709. This has a wall on the opposite side of the golfer, which will essentially train the golfer to avoid hitting the wall and, therefore, correcting a slice by maintaining proper hand position.

Another reference that can be found is Cooper, U.S. Pat. No. 5,346,220. This device is designed specifically to teach a golfer how to execute the inside-out swing properly. Execution of the inside-out swing is essential if a golfer wants to correct a slice.

Another reference can be found Townsend, U.S. Pat. No. 7,130,910, which is a golf-swing training template. Again, this is not a similar structure.

There are other golf training references and representative examples of these include DeJesus, U.S. Pat. No. 5,879,164, and Van Cott, U.S. Pat. No. 5,836,829.

BRIEF SUMMARY OF THE INVENTION

It is important in the game of golf to have the ball travel fairly straight down the fairway. A common problem, however, with golfers is the slice of the ball, wherein once hit, trails away to the right for a right-handed golfer and trails off to the left for a left-handed golfer. In order to correct this type of swing, it is imperative that the golfer learns the inside-out swing properly. This is one of the most difficult skills to master in the game of golf but is absolutely essential if one wants to obtain a true and accurate shot and improve his or her golf game.

In order to train the golfer, the structure is laid on the ground. The structure will have a defined opening with defined angles as well as slightly raised sides to form a channel or gate through which the club is swung by the golfer. The ridges will alert the golfer not to strike the sides of the ridges and the angles will train the golfer to swing through in the correct fashion by training with this device. Once the golfer gets on the golf course, he or she will have perfected the hand movement so that the ball travels in a straight manner down the fairway as opposed to a slice.

This is meant to be a training aid to specifically help the golfer correct a slice. It is designed to be portable and light weight.

NUMBERING DESCRIPTION

Figure 1:
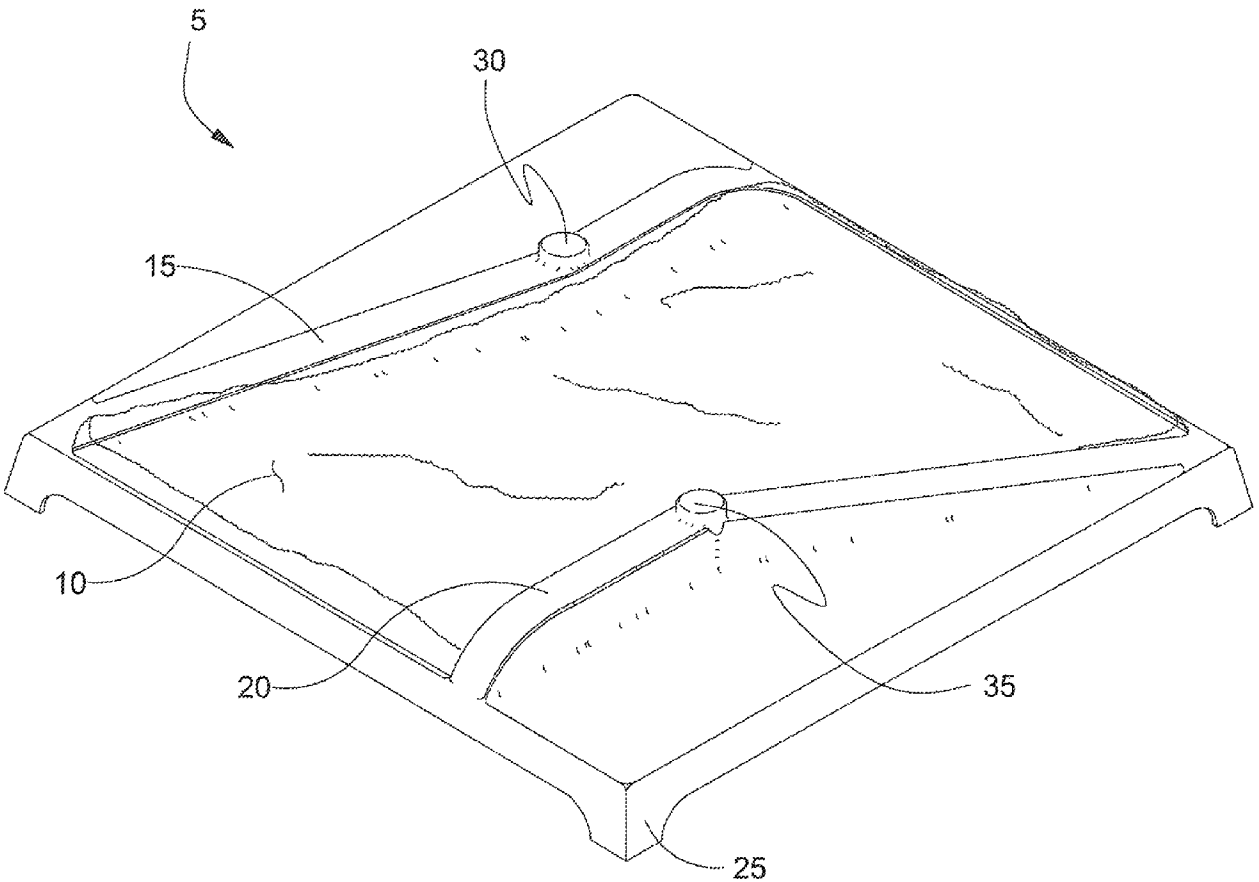
FIG. 1 is an isometric view of the device.
Figure 2:
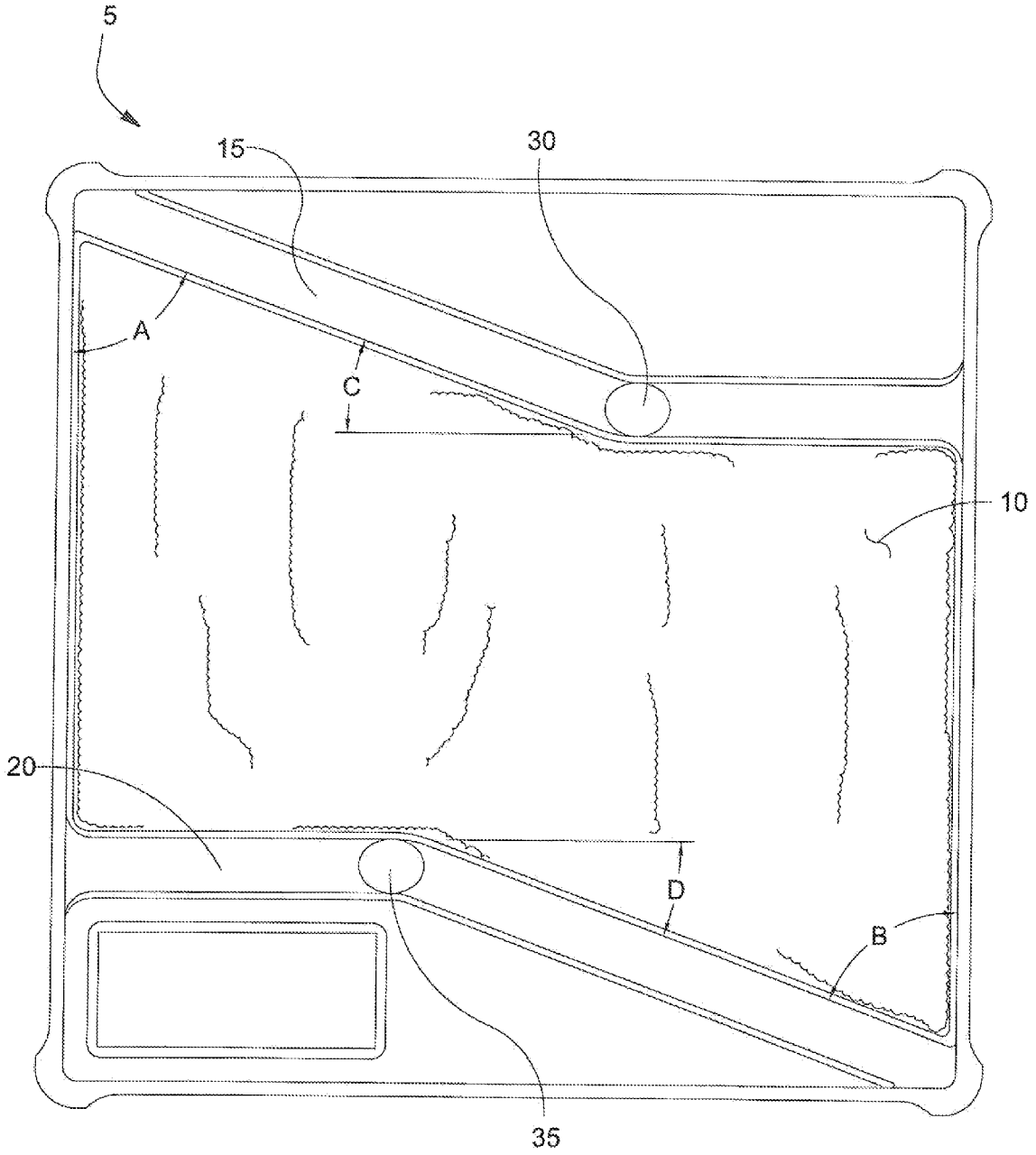
FIG. 2 is a top view of the device.
Figure 3:
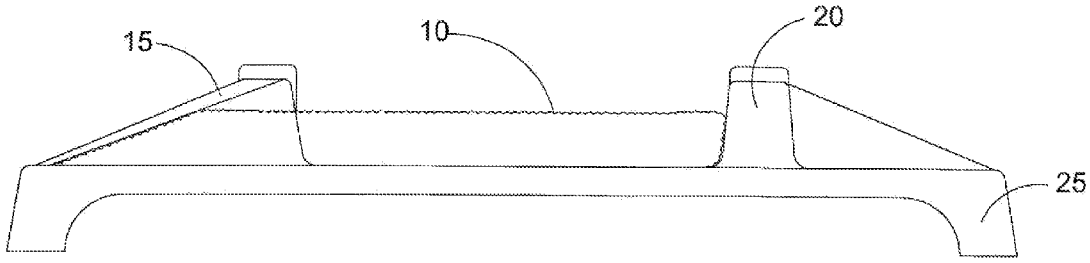
FIG. 3 is a front view of the device.
Figure 4:
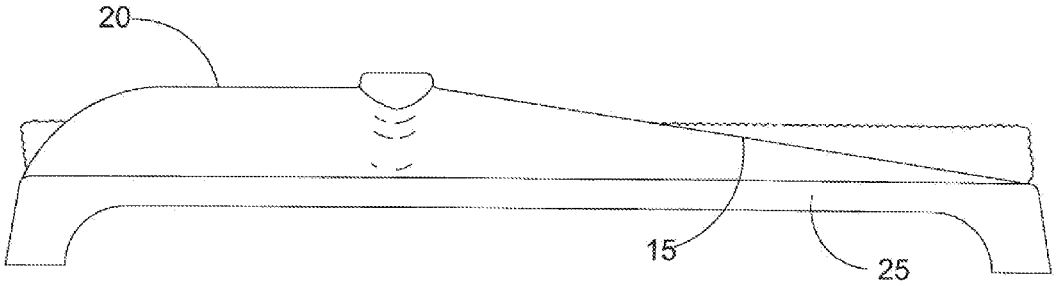
FIG. 4 is a side view of the device.

5—Device
10—Top Surface

15—First side
20—Second side
25—Platform
30—Junction point on First Side
35—Junction point on Second side
A—Entry Angle
B—Exit Angle
C—Angle at Junction point on First Side
D—Angle at Junction point on Second Side

DETAILED DESCRIPTION OF THE EMBODIMENTS

There are many golf training aids and each one of these aids is designed in mind to teach or train a person to perfect a golf swing or a specific golf skill.

In the game of golf a slice is a golf shot that trails away from the golfer. In the case of a right handed golfer a slice will produce a flight path of the ball that will move away from the golfer or to the left of the fairway. In the case of a left handed golfer the slice will produce a flight path of the ball that will move away from the golfer or to the right of the fairway. Regardless of whether or not the golfer is right handed or left handed, the slice is not the ideal golf shot and the good golfer will spend hours perfecting the swing to avoid that particular shot.

This device is a portable, lightweight item that is placed on the ground and will be slightly elevated on a platform 25.

On the top surface will be a first side 15 and a second side 20. For purposes of this example the first side is closest to the golfer when the device is used. A ball is placed on the ground surface 10 between the first side 15 and the second side 20 on an artificial line connecting the junction point on the first side to the junction point on the second side.

A ball is placed on this artificial line prior to being struck roughly at the midpoint of the line. As the club moves to strike the ball the golfer will be aware of the raised sides, 15 and 20 and will avoid striking those sides. In this fashion the club face moves through the ball in a straight manner and producing the ideal shot.

The respective sides will form a very specific angle A on the entry to the ground surface and along the side to the point where it becomes parallel to the player. The entry angle A is in the range of eighty-eight degrees and the angle that is formed at the junction point, C, is in the range of twenty to thirty degrees.

On the opposite side of the surface will be a corresponding angle D at the junction point where the side becomes no longer parallel to the player's swing and that angle is approximately thirty degrees. A corresponding angle B is formed at the point where the side joins the outside point of the device as the ball exits the device and this angle is approximately sixty-five degrees. Right angles are found at two points on the top surface. The first right angle is located across from angle B and the second right angle is located across from angle A. In other words the two right angles are opposite each other.

The angles, A, B, C and D will allow the person to strike the ball and direct the club in a very specific motion between the first 15 and second 20 sides as the club face travels across the top surface 10.

Figure 5:
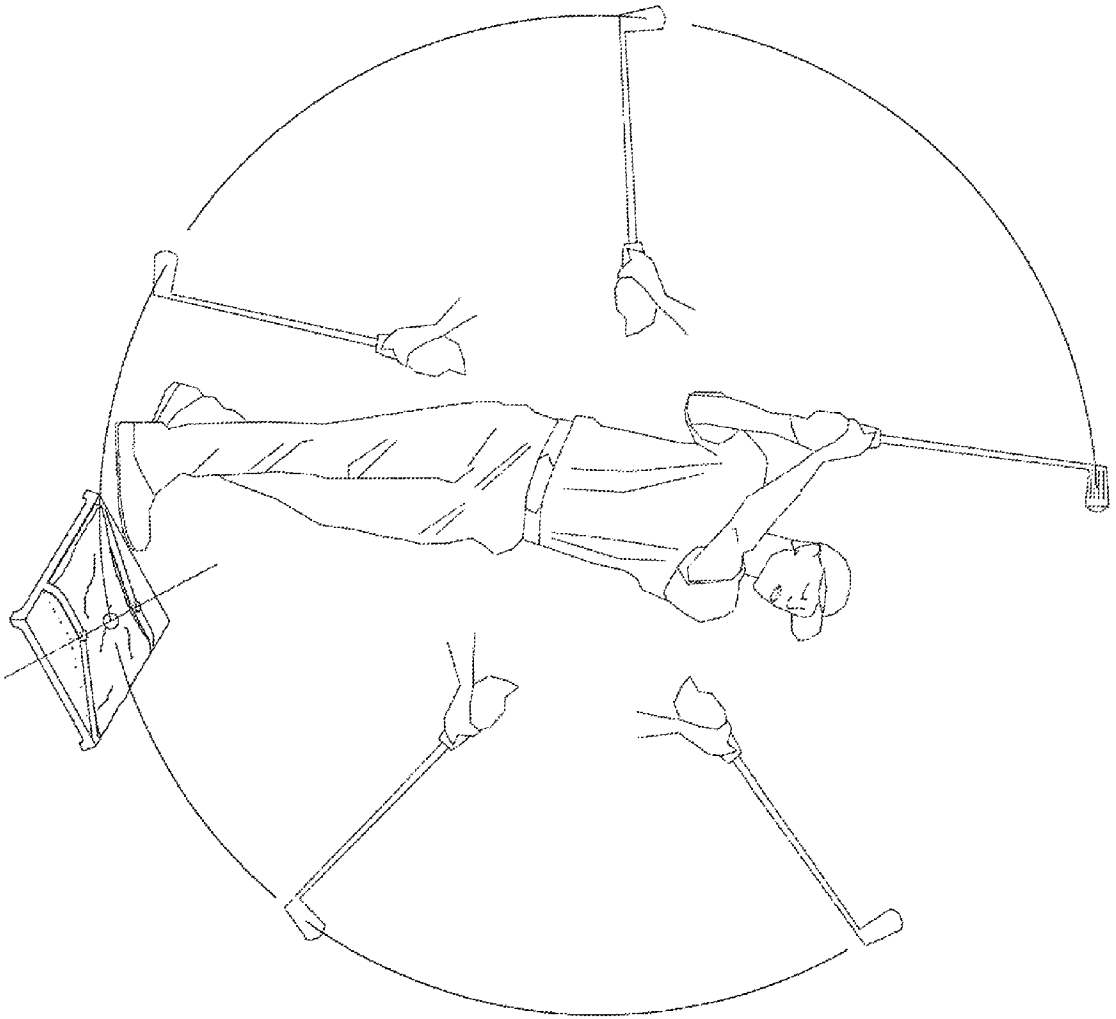
FIG. 5 is an in use view.

By placing the ball on this imaginary line it provides a gate for the golfer to swing through as depicted in FIG. 5; the club that is held by the golfer will travel between the first and second side of the device. Through repetition the golfer will master the art of the swing to overcome the slice.

While the embodiments of the invention have been disclosed, certain modifications may be made by those skilled in the art to modify the invention without departing from the spirit of the invention.

The invention claimed is:

1. A device to correct a slice in a golf swing which is comprised of:

a. a platform;

wherein the platform is of a predetermined shape;

wherein the platform is slightly elevated above the ground surface;

b. a top surface;

wherein a predetermined area of the platform is covered with a top surface;

c. a first side;

wherein the first side is adjacent to a portion of the top surface slightly raised above the top surface;

said first side is closest to the user of this device;

d. second side;

wherein the second side is opposite to the user of this device;

said second side is slightly elevated;

e. junction point on the first side;

wherein the first side travels to a junction point on the first side;

wherein an entry angle is formed at an entry of the device; wherein the angle is formed at the junction point between the first side and the junction point of the first side f. junction point on the second side;

wherein the second side travels to a junction point on the second side;

wherein an exit angle is formed at the junction point between the second side and the junction point of the second side; wherein the angle is formed at an exit point on the second side.

2. The device as described in claim 1 wherein the entry angle on the first side is in the range of eighty-eight degrees.

3. The device as described in claim 1 wherein the angle at the junction point on the first side and the first side is in the range of thirty degrees.

4. The device as described in claim 1 wherein the exit angle on the second side is in the range of sixty-six degrees.

5. The device as described in claim 1 wherein the angle formed at the junction point of the second side and the second side is in the range of thirty degrees.

6. A method to use the device that is described in claim 1 which is comprised of the following steps:

a. placing a ball on the top surface;

b. swinging a club to strike the ball;

c. wherein the path of the club is between the first and second side of the top surface;

d. repeating the steps.

* * * * *